US005897209A

United States Patent [19]

Roegner

[11] Patent Number: 5,897,209

[45] Date of Patent: Apr. 27, 1999

[54] MULTIPOCKETED CASE

[76] Inventor: DeAnna Roegner, 6133 Eagle Lake La., San Ramon, Calif. 94583

[21] Appl. No.: 09/042,143

[22] Filed: Mar. 13, 1998

Related U.S. Application Data

[63] Continuation of application No. 08/671,396, Jun. 26, 1996, abandoned, which is a continuation-in-part of application No. 29/041,011, Jun. 26, 1995, Pat. No. Des. 379,267.

[51] Int. Cl.[6] ..... B65D 30/22

[52] U.S. Cl. ..... 383/39; 150/113; 190/110

[58] Field of Search ..... 383/39; 150/113; 190/901, 109, 110

[56] References Cited

U.S. PATENT DOCUMENTS

| | | | |
|---|---|---|---|
| D. 276,954 | 1/1985 | Kruger | D3/43 |
| D. 345,651 | 4/1994 | Copp | D3/285 |
| D. 355,301 | 2/1995 | Tumulty | D3/289 |
| D. 358,483 | 5/1995 | Cross et al. | D3/276 |
| 1,513,514 | 10/1924 | London | 383/39 |
| 1,684,232 | 9/1928 | Levit | 383/39 |
| 1,705,149 | 3/1929 | Brady | 383/39 |
| 2,011,879 | 8/1935 | Stein | 190/901 X |
| 2,359,372 | 10/1944 | Leader | 383/39 |
| 2,532,517 | 12/1950 | Schwartzman et al. | 383/39 |
| 2,554,215 | 5/1951 | Schell et al. | 190/901 X |
| 2,674,288 | 4/1954 | Laidlaw | 383/39 X |
| 2,873,781 | 2/1959 | Langley | 383/39 |
| 3,533,459 | 10/1970 | Ody | 150/113 |
| 4,506,769 | 3/1985 | Franco et al. | 190/127 X |
| 4,513,866 | 4/1985 | Thomas | 190/110 X |
| 4,569,082 | 2/1986 | Ainsworth et al. | 383/3 |
| 4,585,127 | 4/1986 | Benedict | 383/39 X |
| 4,739,809 | 4/1988 | Adams | 150/112 |
| 4,854,432 | 8/1989 | Carpenter et al. | 190/110 |
| 4,960,204 | 10/1990 | Young et al. | 383/39 X |
| 5,052,555 | 10/1991 | Harmon | 206/315.11 |
| 5,096,030 | 3/1992 | Espinosa et al. | 190/110 X |
| 5,160,001 | 11/1992 | Marceau | 190/102 |
| 5,598,923 | 2/1997 | Owens | 383/39 X |

FOREIGN PATENT DOCUMENTS

| | | | |
|---|---|---|---|
| 1287867 | 2/1962 | France | 383/39 |
| 87 15 908 | 1/1987 | Germany | 150/113 |

*Primary Examiner*—Jes F. Pascua
*Attorney, Agent, or Firm*—Baker & Maxham

[57] ABSTRACT

A multipocketed carrying case, comprises a primary shell of pliable material formed of a pair of substantially identical half shells connected together for hinging along a common side and forming a primary receptacle, each half shell formed of a rectangular back panel with a bottom panel, a top panel and two end panels secured along the periphery of the back panel forming a primary receptacle, a multi-pocket panel assembly secured to the back panel and comprising a zig zag folded panel forming overlapping front and back folds, the back folds secured to a back panel forming a plurality of pockets having spaces therebetween, and a closure panel secured along an edge to the back panel to thereby overlap and close the plurality of pockets.

18 Claims, 10 Drawing Sheets

10

MULTIPOCKETED CASE

REFERENCE TO RELATED APPLICATION

The present application is a continuation of Ser. No. 08/671,396, filed Jun. 26, 1996 now abandoned, which was a continuation-in-part of design application Ser. No. 29/041,011, entitled "MULTIPOCKETED CASE", filed Jun. 26, 1995, now Design Pat. No. D379,267.

BACKGROUND OF THE INVENTION

The present invention relates to carrying cases and pertains particularly to an improved carrying case having an improved arrangement of multiple pockets.

Many people when traveling carry many items which are often placed loosely in a suitcase. This leaves the items disorganized and often difficult to easily locate. There are also many people who are engaged in professions or trades that require them to carry numerous different items such as samples or tools. These items or tools are often transported to a work site in a special carrying case that is specially designed for the specific tools or items required.

There is a need for a carrying case that is adaptable to carry many different related or unrelated items in an organized fashion. It would be desirable to have a case with multiple pockets for holding articles of different sizes in a secure manner and readily accessible.

SUMMARY OF THE INVENTION

It is the primary object of the present invention to provide an improved case with multiple pockets for holding articles of different sizes secure and readily accessible.

A multipocketed carrying case, comprises a primary shell of pliable material, said shell formed of a pair of substantially identical half shells connected together for hinging along a common side and forming a primary receptacle, each half shell formed of a rectangular back panel with a bottom panel, a top panel and two end panels secured along the periphery of the back panel forming the receptacle, a multipocket panel assembly secured to said back panel and comprising a zig zag panel forming overlapping front and back panels, the back panels secured to a back panel forming a pleated or plurality of pockets having spaces therebetween, and a closure panel secured along an edge to said back panel to thereby overlap and close said plurality of pockets.

In an alternate embodiment of a multi-pocket assembly is detachably secured to the back panels of the shell and includes means for hanging from a hanger or the like to enable a pocket assembly to be used with multiple cases or multiple pocket assemblies to be used with a single case.

BRIEF DESCRIPTION OF THE DRAWINGS

The above and other objects and advantages of the present invention will become apparent from the following description when read in conjunction with the accompanying drawings wherein.

DETAILED DESCRIPTION OF THE PREFERRED EMBODIMENTS

Figure 1:
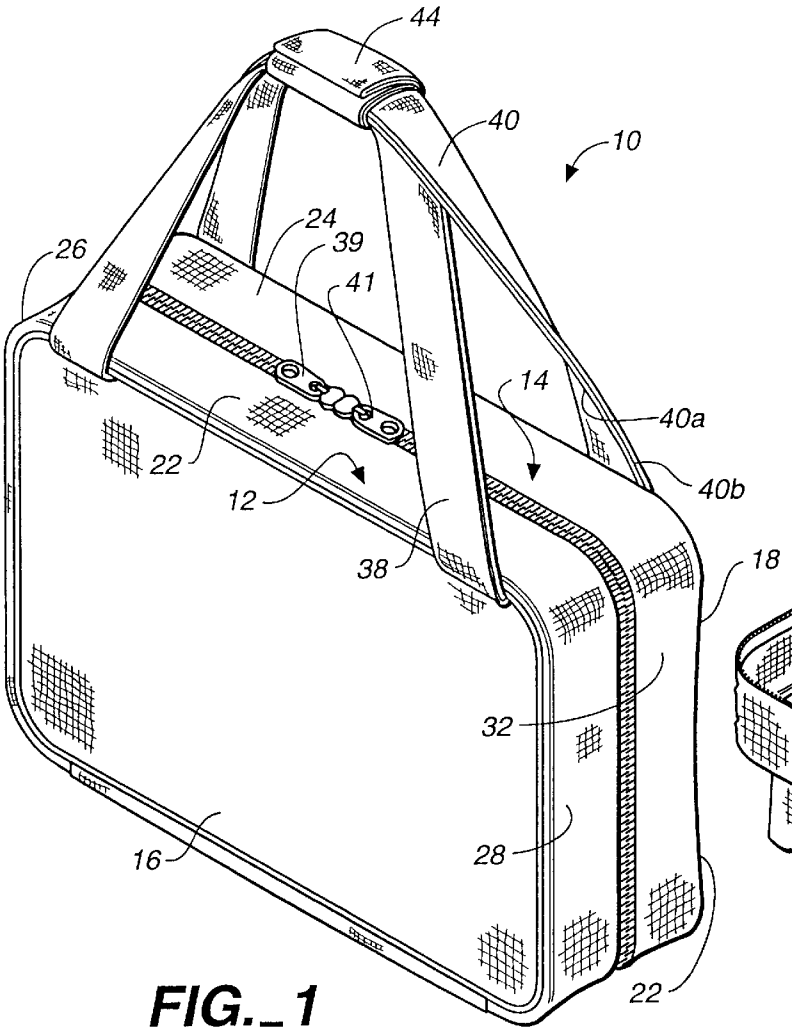
FIG. 1 is a perspective view of exemplary preferred embodiment of the invention with the case closed.

Referring to FIG. 1 of the drawing, the carrying case in accordance with the invention is illustrated and designated generally by the numeral 10. The case is preferably constructed of a pliable material, such as leather, vinyl, or any of the suitable woven materials, now widely used for suit cases and the like. The case comprises a primary shell formed of a pair of substantially identical half shells 12 and 14, hinged together along a common side and forming a primary receptacle. Each shell is formed of a generally rectangular back panel 16 and 18 respectively, with a bottom panel 20 which is preferably common to both half shells with a continuous strip forming top panels 22 and 24, end panels 26, 28, 30 and 32, respectively, for forming each of the half shells into the primary receptacle. The half shells are secured together along edges of the side and top panels by zipper elements 34 and 36 with sliders 39 and 41 at each side or end of the zipper elements. The bottom panel 20 flexes to serve as a hinge for the two half shells.

Each half shell is provided with an elongated carrying strap 38 and 40, respectively, which detachably secure together at a mid point and are preferably adjustable in length to serve as either a handle or a shoulder strap. The strap 40, for example, is preferably secured at one end directly to the side of the shell and at the other end through a slip loop and to the shell with the opposite end adjustably secured by a buckle (not shown) underneath a hand grip 44. The hand grip 44 is of conventional construction and preferably forms a slip sleeve over the buckle of one of the straps and opening sleeve secured together in a closed position around the other buckle by suitable means, such as hook and loop fastening means, such as that available under the trademark VELCRO. This enables the straps to be adjusted so that they may serve as a hand carrying strap or shoulder strap, as desired.

Figure 2:
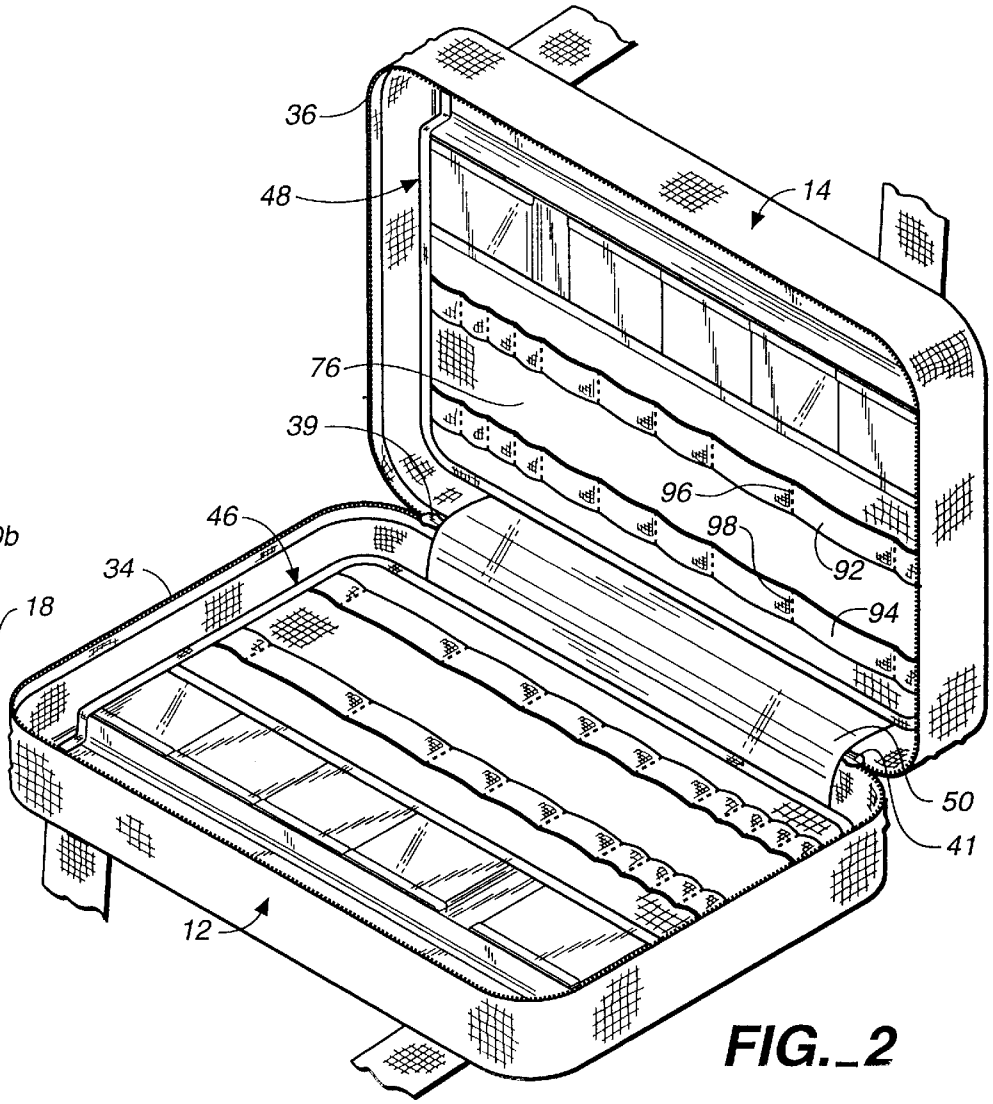
FIG. 2 is a perspective view of the embodiment of FIG. 1 with the case open.

As seen in FIG. 2, the overall carrying case is provided with substantially identical pocket assemblies designated generally by the numerals 46 and 48, respectively, separately positioned in each of the respective half shells. The pocket assemblies are in a preferred form formed on a common back panel 50 which extends into and may preferably form at least a partial liner in each receptacle of each half shell. The back panel 50 may preferably be a transparent material, such as vinyl or the like.

Figure 3:
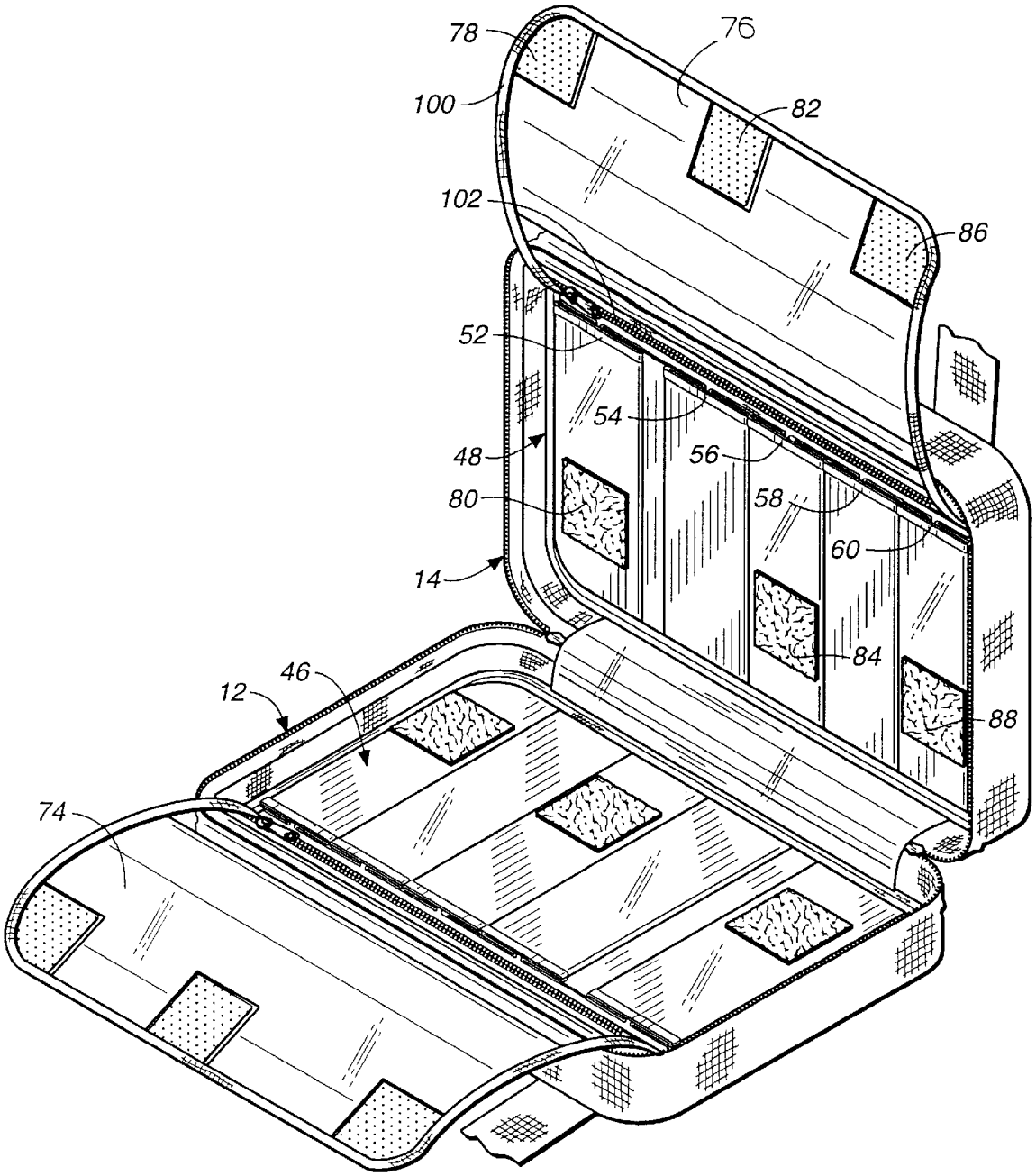
FIG. 3 is a perspective view of the invention as in FIG. 2 with an internal flap folded forward to be open in the bottom half; a similar internal flap present in the top half with the flap shown in its open position.

Referring to FIG. 3, the pockets of each of the pocket assemblies in this embodiment is illustrated as extending from the bottom of the shell, as viewed in FIG. 1, to the top of the shell so that when standing in FIG. 1, the openings of the pockets are positioned at the top of the case. However, as will be appreciated, the pocket assemblies may be formed such that the pockets open in a common direction when viewed as in FIG. 4 or 5, so that the case can be hung in a manner that all pockets open to the top or upward.

The pocket assembly for each half shell is identical and therefore only a single pocket assembly will be described in detail. With reference to FIG. 3, the pocket assembly 48 will be described. As best seen in FIG. 3, the pocket assembly has five primary open top pockets, 52, 54, 56, 58, and 60, respectively and alternate open sided pockets between them. The pockets are formed of an overlapping transparent panel with pleated or zig zag accordion-like folds, as can be seen in FIGS. 3 and 11, that form collapsed pockets with folded sides between a forward or front and a rearward or back panel section of each pocket.

Figure 11:
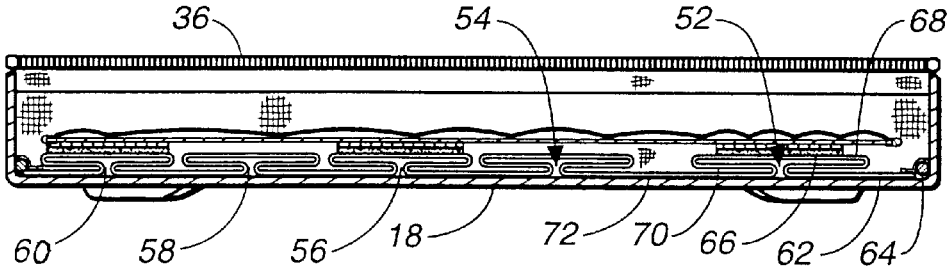
FIG. 11 shows a cross section of FIG. 5 taken at 11—11 showing pockets of the multipocketed design.

Referring to FIG. 11, the pockets are formed by a continuous panel that is folded in the pleated or zig zag collapsed position as shown, when the pockets are empty. The pockets are formed by the panel which is folded so that with respect to pocket 52, for example, an aft panel portion 62 lies against the back pocket panel 18 and is secured along an edge 64 to the back pocket panel and/or the panel 18 of the shell. A side portion or section 66 is folded down between the aft panel portion 62 and a fore or front pocket panel 68 which forms the front of the pocket. The excess material of side portions 66 (FIG. 11) permits expansion of the open top pockets and provides size, shape and definition to the open sided pockets between the open top pockets.

The opposite side of the pocket is similarly formed with a folded side pocket panel portion or section 70 and an adjacent aft panel portion 72. The aft panel portion 72 is preferably secured along a proximate center line to the back panel 18. The remaining pockets, as can be seen in FIG. 11, are similarly constructed with collapsed or folded sides such that when the pocket is partially filled an adjacent space between adjacent pockets form an open sided pocket and is available for the placement of additional articles. However, the pockets are constructed so that they can be completely filled, such that no additional space or open sided pockets exists between adjacent pockets. Also, as can be appreciated from viewing FIGS. 3 and 11, the adjacent pockets 52 and 54 may be spaced further apart than other pockets within the unit to provide a larger or open sided pocket between them. These pockets are also constructed to be slightly larger than the other pockets. As can be seen from FIGS. 3, 5, 13 and 15, the edge of the front, pleated panels opposite to the open tops of pockets 52, 54, 56, 58, 60 are secured to back panel 18 to effectively close the bottom ends of the open sided pockets which are formed between the open top pockets.

Referring back to FIG. 3, each of the pocket assemblies includes a flap or cover 74 and 76, each of which is preferably at least partially transparent, preferably at the top of the pockets. These covers or flaps are preferably secured to the pocket assembly along a top edge of the pocket assembly adjacent to the openings or tops of the respective pockets. The flap can thus fold down over the pockets to retain items in the both the open top and the open sided pockets. Suitable securing means for securing the flaps or covers closed, preferably includes pairs of hook and loop type fasting means 78, 80, 82, 84, 86 and 88.

Referring now back to FIG. 2, wherein the flap or cover 76 is shown closed over the pockets of the pocket assembly 48. It will be seen that the upper portion of the cover 76 is transparent at the top of the pockets. The outer face of the panel, as shown in FIG. 2, includes a pair of elongated elastic straps 92 and 94 secured such as by stitching at multiple points, such as 96 and 98 along the face of the panel, shown in FIG. 2, to form a plurality of loops for holding additional small articles.

As seen in FIG. 3, each panel is also preferably formed of two layers of material secured around the peripheral edge by a band 100 and with an opening formed with a zipper 102 to provide access to the pocket. The pocket is suitable for small, thin items, such as papers and the like.

Figure 4:
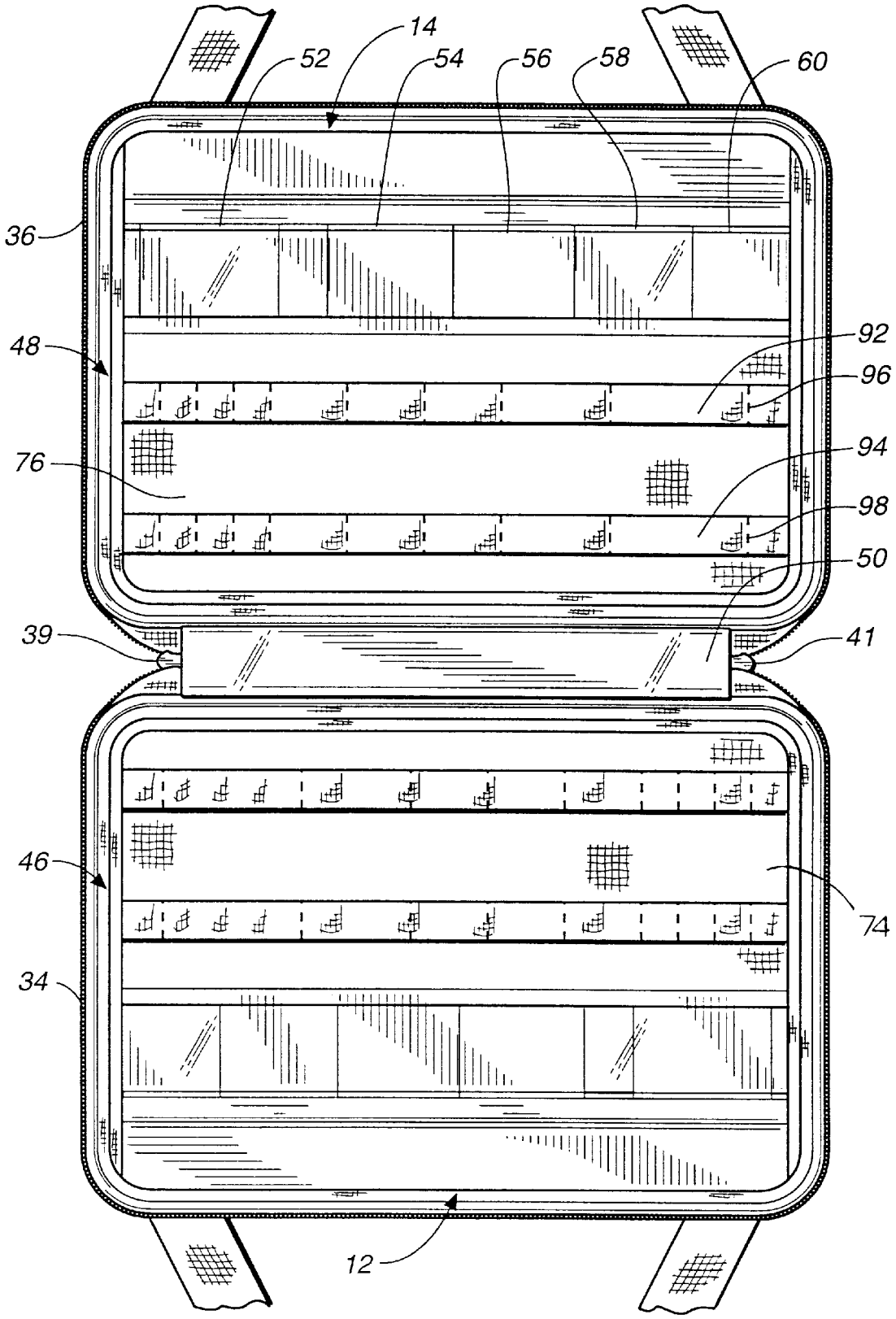
FIG. 4 is a top view of the invention showing the inside construction with the case folded flat in an open clam shell configuration; both internal flaps in their closed position.
Figure 5:
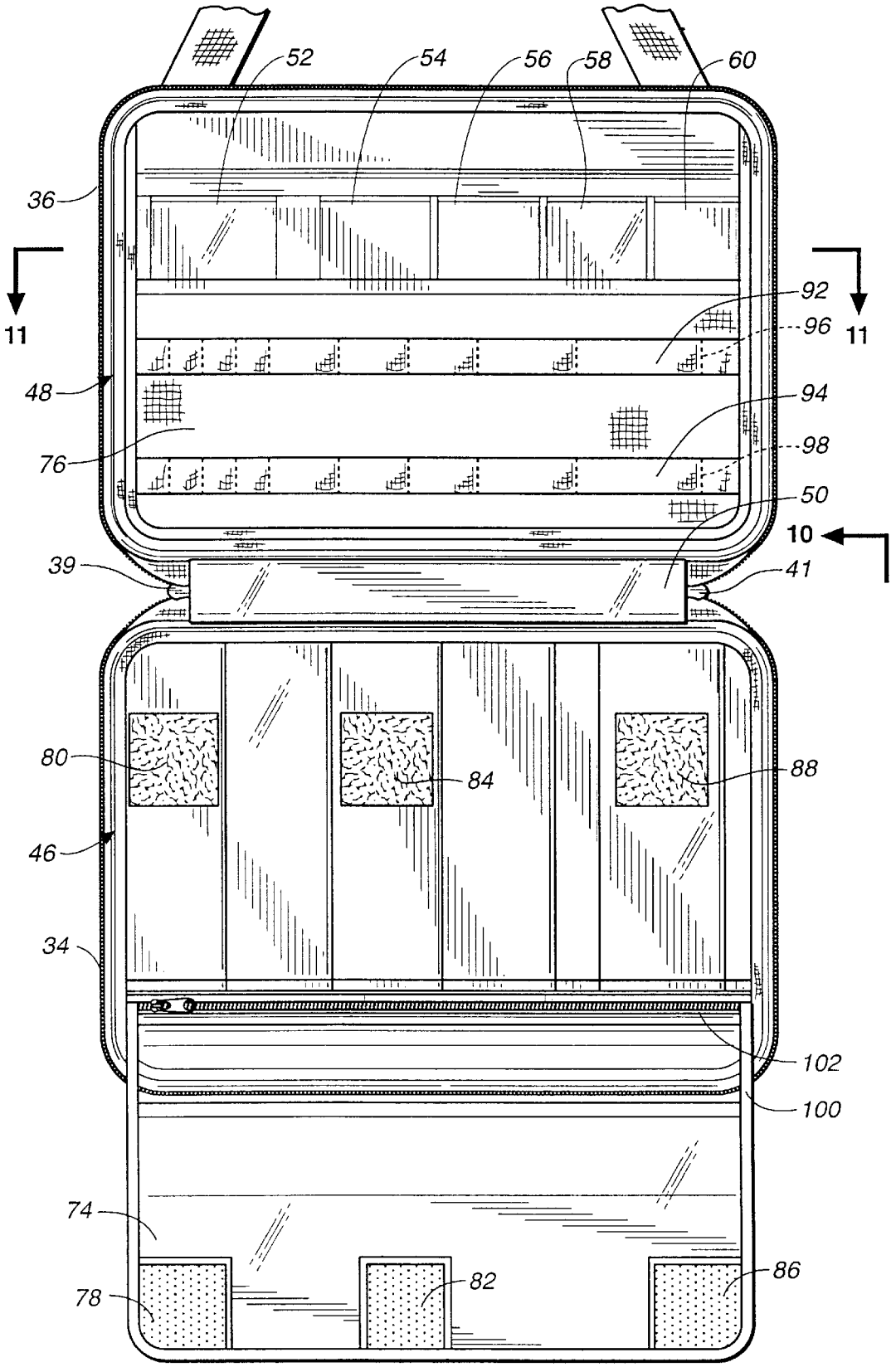
FIG. 5 is a top view of the invention showing the inside construction with the case folded flat in an open clam shell configuration as in FIG. 4 with the internal flap of the lower half folded open; with the internal flap of the upper half shown in its closed position.
Figure 6:
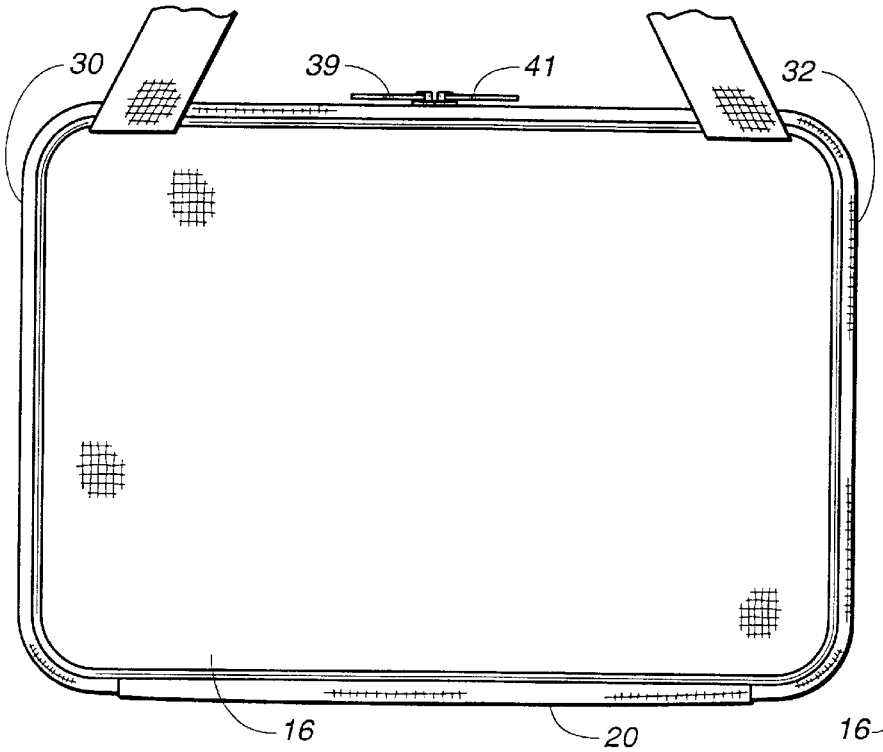
FIG. 6 is a front elevation view of the outside of the case with part of the hand straps being cut away, the back view being identical.

Referring to FIGS. 4 and 5, the case is shown fully open like a book with both pocket assemblies covered. The flaps 74 and 76 open over the pockets from opposite sides like the pages of a book to provide access to the pockets. The flaps are transparent at least in the portions over the top or openings of the pockets so that articles may be easily seen and identified.

Figure 7:
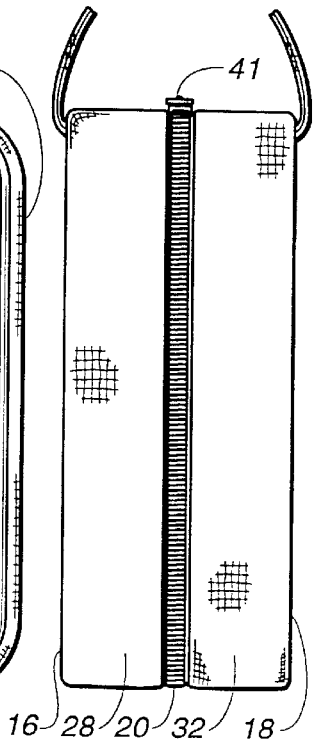
FIG. 7 is a right side view of FIG. 6, the left side being identical.
Figure 8:
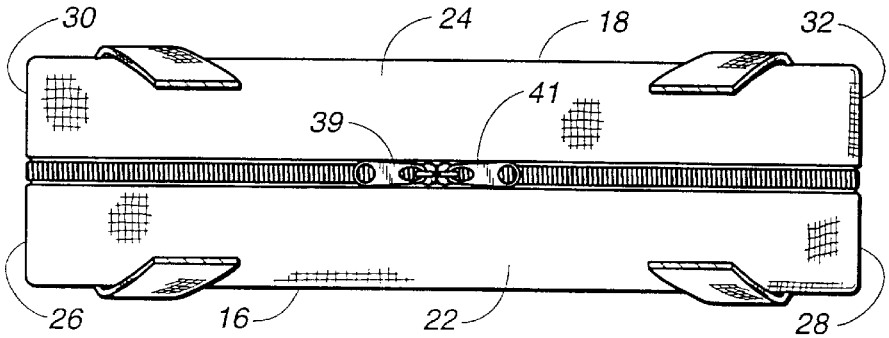
FIG. 8 is a top view of FIG. 6.
Figure 9:
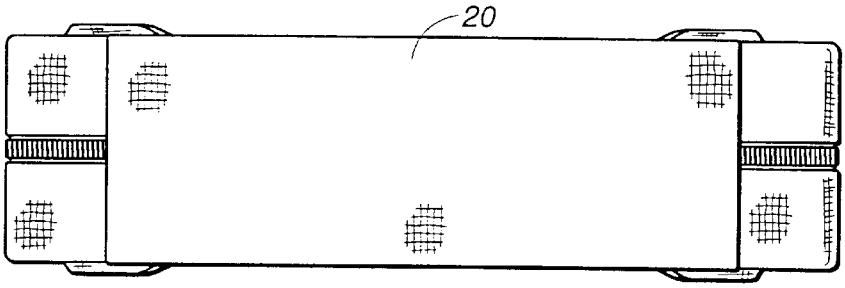
FIG. 9 is a bottom view of FIG. 6.
Figure 10:
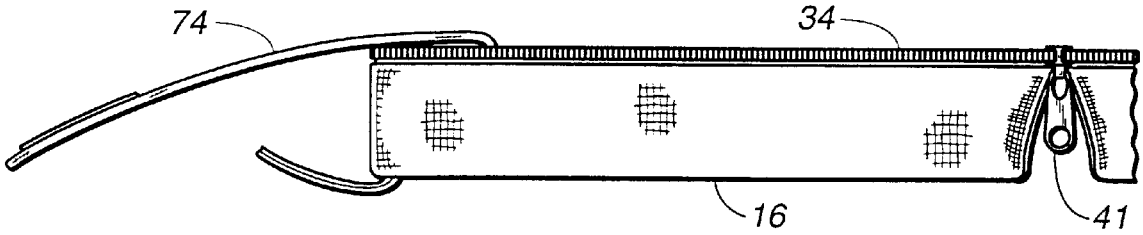
FIG. 10 is a partial side view of FIG. 5 taken at 10—10 showing one of the internal flaps folded open, with part of the lower handle shown cut away.

Referring to FIGS. 6 through 9, the case is shown to have a generally rectangular box-like configuration with a relatively flat bottom so that it can stand as shown in FIG. 7. The zipper divides the case in half and is arranged to enable the sliders to come together at the top as shown. The zipper also extends into the bottom as shown in FIG. 9 to enable the two half shells to fully open as shown in FIG. 10.

Figure 12:
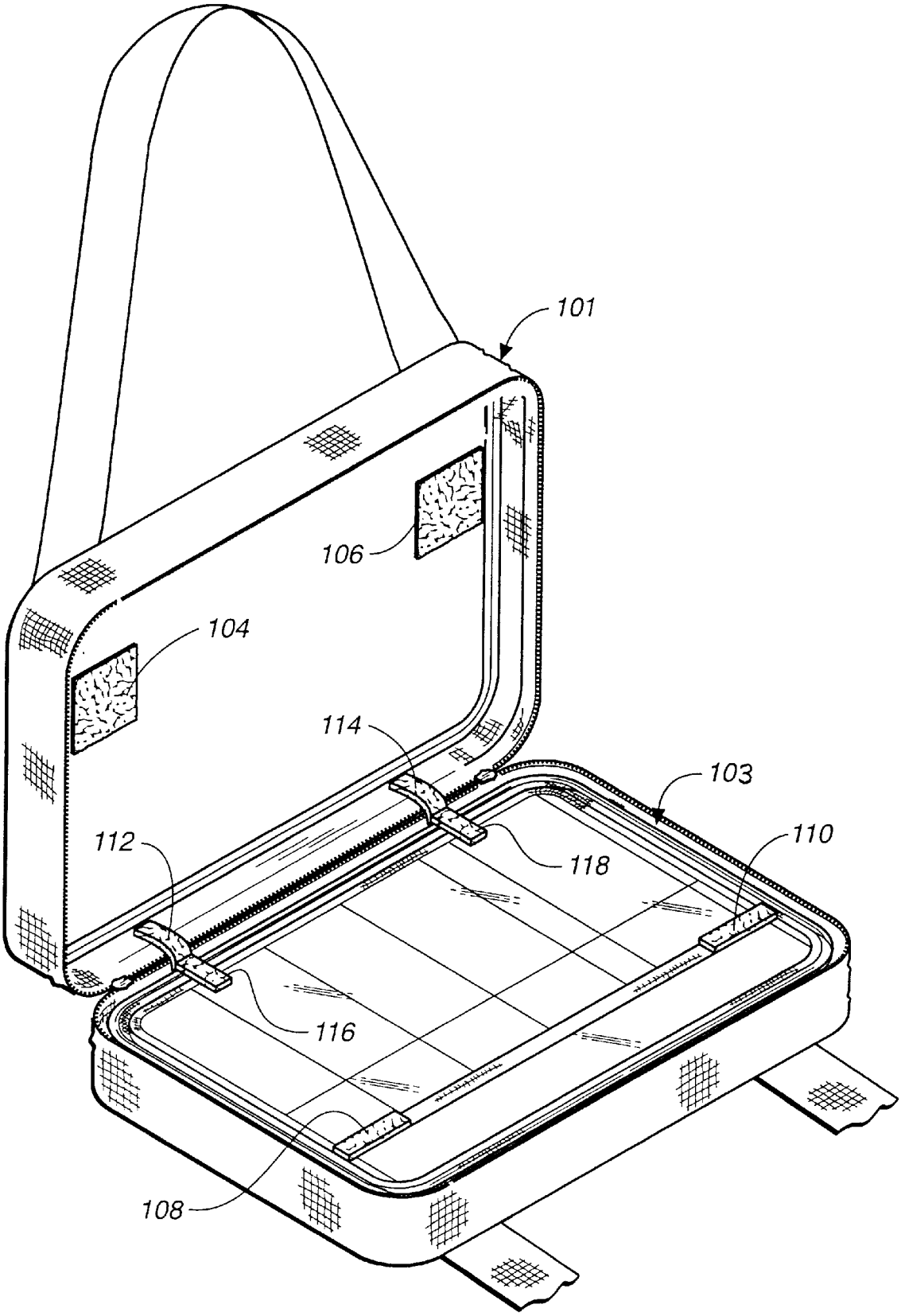
FIG. 12 is a perspective view of an alternate embodiment with the case open to show the removable pocket assembly arrangement.
Figure 13:
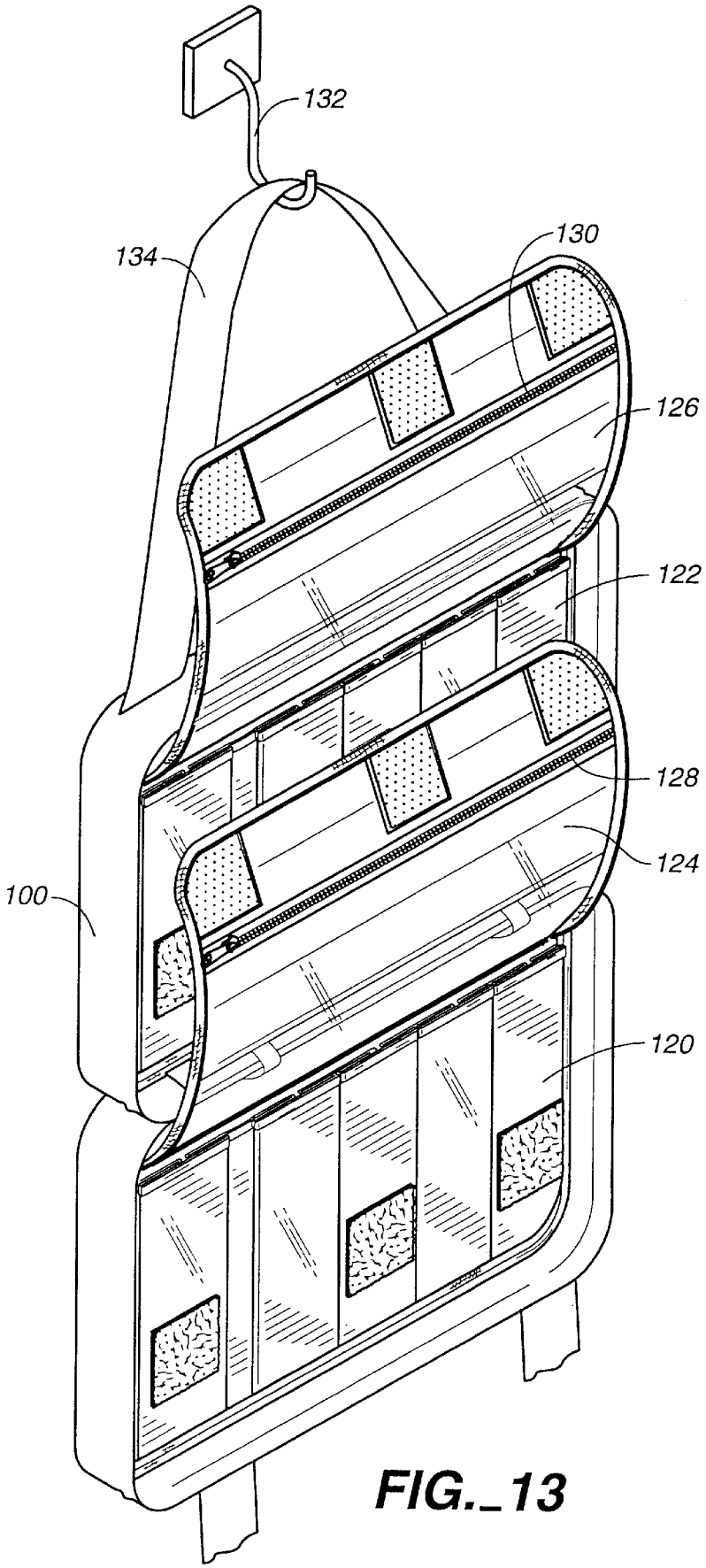
FIG. 13 is a perspective view of the embodiment of FIG. 12 with the case hanging up and open to show the removable pocket assembly arrangement.
Figure 14:
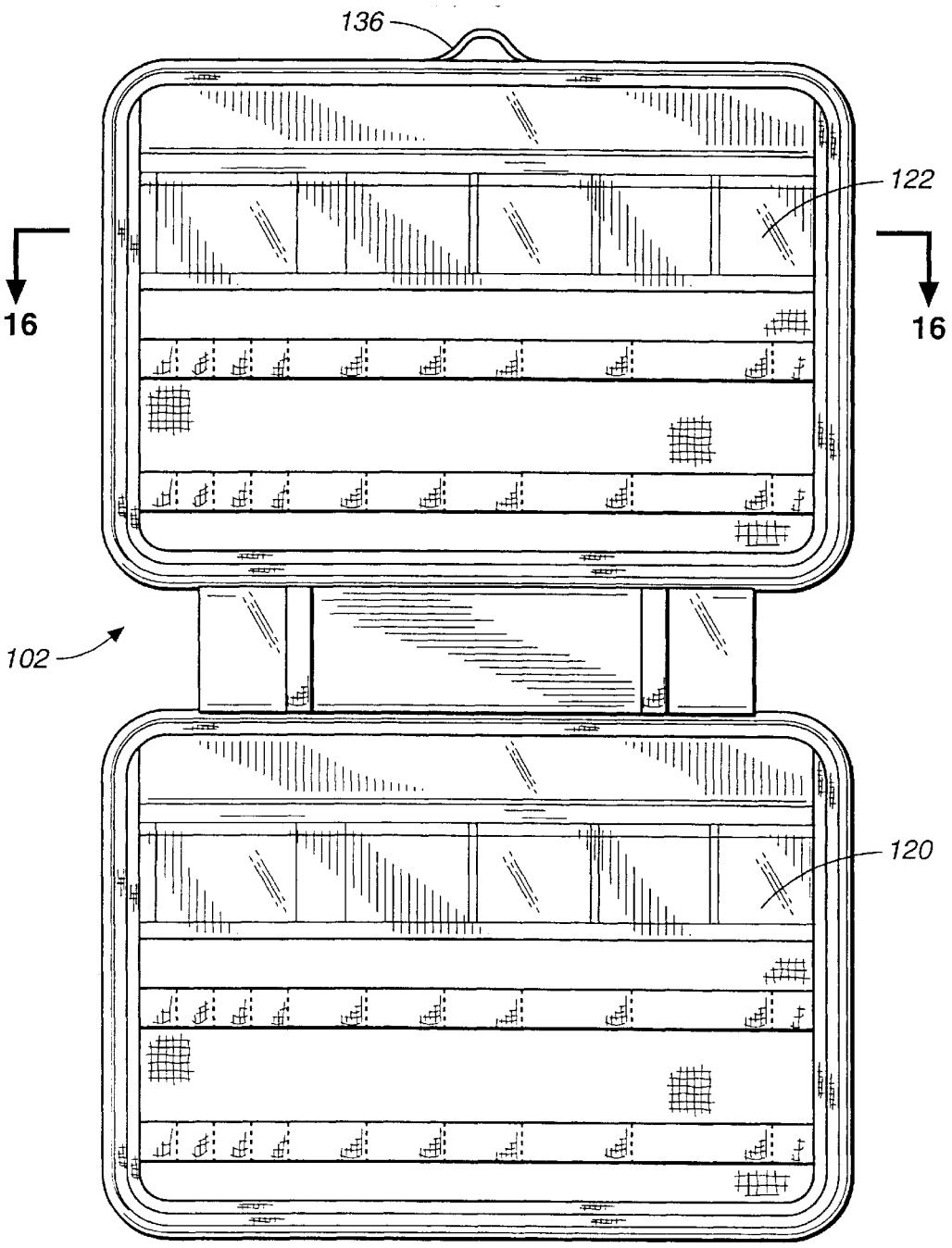
FIG. 14 is a front elevational view of the removable pocket assembly of FIG. 12 shown hanging up and closed to show the removable pocket assembly arrangement.

Referring to FIGS. 12–14, a further modification of the case and pocket assembly includes forming the pocket assemblies as a separate integral structure for detachable mounting in the case of shell. The case 101 as illustrated in FIG. 12 is identical to that of the prior embodiment except that the pocket assembly designated generally by the numeral 103 is detachably mounted therein. The upper portion of the pocket assembly is shown detached from the upper half-shell and folded down to show the detachable hook and loop fastening means. Each half-shell has hook and loop fastening pads (upper shown) 104 and 106 on the inside of the back panel for engagement with corresponding pads 108 and 110 on the back of the pocket assembly 103. Additional hook and loop fastening pads or strips 112 and 114 are provided at the juncture of the two half shells with corresponding strips 116 and 118 on the pocket assembly. This provides for complete and secure detachable mounting of the pocket assembly inside the shell.

Referring to FIG. 13, the pocket assembly is shown with both pocket units or sections 120 and 122 opening upwardly with closure panels 124 and 126 attached and pivoting above the pocket openings. Each closure panel 124 and 126 forms a pocket with zipper closures 128 and 130. The entire case can be hung on a hook 132 by means of carrying strap 134.

Referring to FIG. 14, the pocket assembly is provided with a hanging loop 136 so that it can be removed from the case and separately hung from a hanger or suitable hook (not shown).

Figure 15:
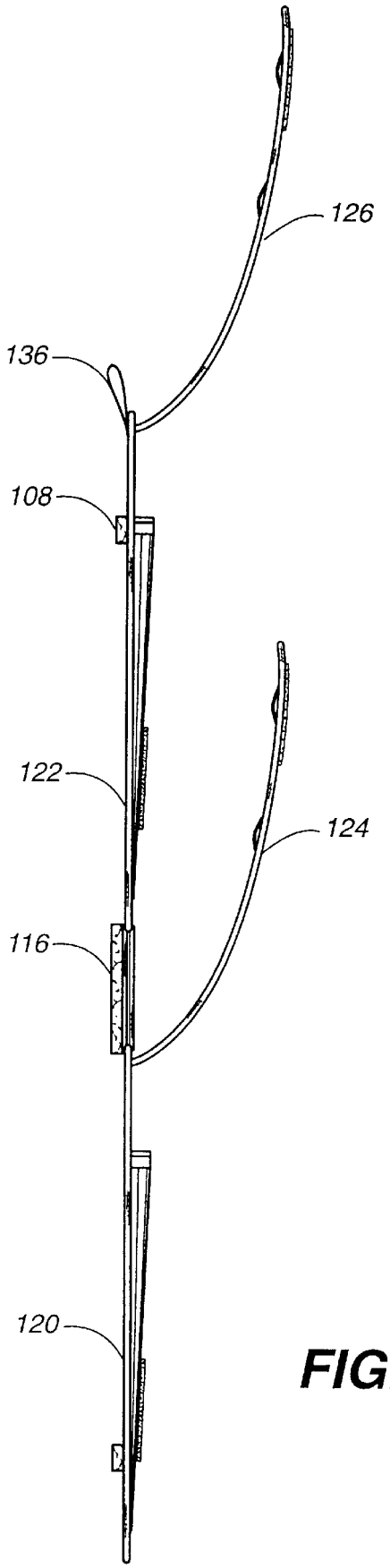
FIG. 15 is a side elevational view of the removable pocket assembly of FIG. 12 with the pockets open to reveal additional details.

Referring to FIG. 15, a side view of the pocket assembly is illustrated showing the two pocket units 120 and 122 on a common backing panel and with the cover panels 124 and 126 in the open position. A loop 136 or other suitable means for hanging the pocket assembly is provided at the top of the assembly.

Figure 16:
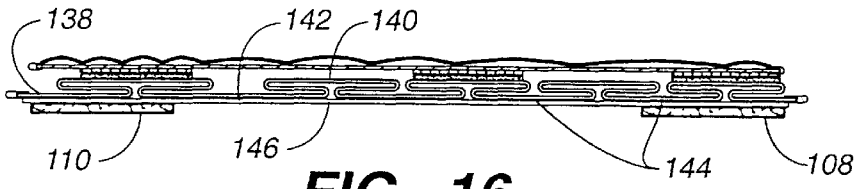
FIG. 16 is a sectional view of the removeable pocket assembly taken on line 16—16 of FIG. 14 to reveal additional details.

Referring to FIG. 16, a sectional view of the assembly is illustrated showing details of the pocket construction. As shown, the primary pockets are formed by a pocket panel 138 folded in overlapped accordion fashion with fore panel sections 140 and aft panel sections 142 with folded side sections. The aft panel sections 142 are secured by suitable bonding or sewing along lines 144 to a common back panel 146.

With such an arrangement, a user may use two or more pocket assemblies for interchangeable use with a given case. One pocket assembly, for example, may be filled with personal items for personal travelling, whereas a second pocket assembly may be filled with sales items for a sales trip or business items for other types of business travel. Similarly, a person may have two or more cases of special designs for special occasions and may interchange one or more of the pocket assemblies. The pocket assembly is preferably provided with means such as a loop 136 as described above at a tope edge to provide for hanging the assembly on a hanger or the like.

While I have illustrated and described my invention by means of specific embodiments, it is to be understood that numerous changes and modifications may be made therein without departing from the spirit and the scope of the invention as shown in the appended claims.

I claim:

1. A multipocketed carrying case, comprising:

a primary shell of pliable material, said shell formed of a pair of substantially identical half shells connected together for hinging along a common side and forming a primary receptacle. each said half shell formed of a rectangular back panel with a bottom panel, a top panel and two end panels secured along the periphery of said back panel forming said primary receptacle;

a multi-pocket assembly mounted on said back panel of one of said half shells inside said primary receptacle, said multi-pocket assembly comprising a back pocket panel and a front pocket panel, said front pocket panel being folded to form front panel sections and pleated side panel sections, said front panel sections overlapping said side panel sections, said front pocket panel being secured to said back pocket panel to thereby form a plurality of alternating first pockets having an open top and second pockets having an open side, said first and second pockets being generally the same length and shaped and configured to receive articles; and a closure panel secured along an edge of said back pocket panel, said closure panel being shaped and configured to simultaneously overlap and close said open top of said plurality of first pockets and enclose said open sides of said second pockets to secure articles therewithin.

2. The carrying case of claim 1 wherein said front pocket panels are transparent.

3. The carrying case of claim 1 wherein said closure panel is at least partially transparent.

4. The carrying case of claim 1 wherein said closure panel is detachably secured over said pocket panel by means of hook and loop fastening means.

5. The carrying case of claim 1 wherein said pockets on said multi-pocket assembly are formed so that when adjacent said first pockets are partially filled, space is available between said adjacent pockets for an article.

6. The carrying case of claim 1 wherein said multi-pocket assembly is detachably mounted in said receptacle.

7. The carrying case of claim 1 wherein said multi-pocket assembly comprises two identical groupings of pockets on a common pocket back panel, and said pockets on said pocket panel have openings oriented in a common direction.

8. The carrying case of claim 7 wherein said closure panel is attached to said back panel adjacent said openings.

9. The carrying case of claim 7 wherein said multi-pocket assembly is detachably mounted in said primary receptacle.

10. The carrying case of claim 9 wherein said pocket panel is detachably mounted in said primary receptacle by means of hook and loop fastening means.

11. The carrying case of claim 10 wherein said closure panel is attached to said back panel adjacent said openings.

12. The carrying case of claim 11 wherein said closure panel is detachably secured over said pocket panel by means of hook and loop fastening means.

13. The carrying case of claim 12 wherein said pockets on said pocket panel are formed so that when adjacent said first pockets are partially filled, space is available between said adjacent said first pockets for an article.

14. The carrying case of claim 13 wherein said closure panel is at least partially transparent at the openings of said first pockets.

15. A multipocketed carrying case, comprising:

a primary shell of pliable material, said shell formed of a pair of substantially identical half shells connected together for hinging along a common side and forming a primary receptacle, each said half shell formed of a generally rectangular back panel with a bottom panel, a top panel and two panels secured along the periphery of said back panel forming said primary receptacle;

a first multi-pocket assembly mounted on said back panel of one of said half shells and a second multi-pocket assembly mounted on said back panel of the other of said half shells inside said primary receptacle, each said multi-pocket assembly comprising a back pocket panel and a front pocket panel, said front pocket panel being folded to form front panel sections and pleated side panel sections, said front pocket panel sections overlapping said side panel sections, said front pocket panel being secured to said back pocket panel to thereby form a plurality of alternating first and second pockets, said second pockets having an open side for receipt of articles; and a closure panel secured along an upper edge of said back pocket panel and shaped and configured to completely overlap and fully cover said plurality of first pockets and said open sides of said second pockets to secure articles therewithin.

16. The carrying case of claim 15 wherein said first multi-pocket assembly and said second multi-pocket assembly are detachably mounted in said primary receptacle.

17. The carrying case of claim 16 wherein said closure panel is at least partially transparent and has loops on an outer surface thereof for holding articles.

18. A multipocketed carrying case, comprising:

a primary shell of pliable material, said shell formed of a pair of substantially identical half shells connected together for hinging along a common side and forming a primary receptacle, each said half shell formed of a generally rectangular back panel with a bottom panel, a top panel and two end panels secured along the periphery of said back panel forming said primary receptacle;

a first multi-pocket assembly detachably mounted on said back panel of one of said half shells and a second multi-pocket assembly detachably mounted on said back panel of the other of said half shells inside said primary receptacle, each said multi-pocket assembly comprising a back pocket panel and a front pocket panel, said front pocket panel being transparent and being folded to form front panel sections and pleated side panel sections, said front panel sections overlapping said side panel sections, said front pocket panel being secured to said back pocket panel to thereby form a plurality of alternating first and second pockets, said second pockets each having an open side so that when said first pockets are partially filled with first articles, said second pockets are of a size to receive second articles generally similar in size to said first articles; and a closure panel secured along an upper edge of said back pocket panel and having a size to overlap and cover said plurality of first and second pockets to secure the articles therewithin, said closure panel being at least partially transparent.

* * * * *